US006666395B2

(12) United States Patent
Cavalieri

(10) Patent No.: US 6,666,395 B2
(45) Date of Patent: Dec. 23, 2003

(54) APPARATUS FOR WIREDRAWING VEGETABLES OR DICING THEM INTO THREE DIMENSIONAL SHAPES

(75) Inventor: Rossano Cavalieri, Parma (IT)

(73) Assignee: Cavalieri SpA, Parma (IT)

( * ) Notice: Subject to any disclaimer, the term of this patent is extended or adjusted under 35 U.S.C. 154(b) by 0 days.

(21) Appl. No.: 10/073,990

(22) Filed: Feb. 14, 2002

(65) Prior Publication Data

US 2002/0119228 A1 Aug. 29, 2002

(30) Foreign Application Priority Data

Feb. 15, 2001 (IT) ..... MO2001A0025

(51) Int. Cl.[7] ..... B02C 19/12

(52) U.S. Cl. ..... 241/85; 241/87; 241/88.1; 241/93; 241/167

(58) Field of Search ..... 241/100, 166, 241/167, 85, 86, 87, 88, 88.1, 93

(56) References Cited

U.S. PATENT DOCUMENTS 1,327,254 A * 1/1920 Remmers ..... 241/85
2,833,481 A * 5/1958 Perks ..... 241/85
3,878,996 A * 4/1975 Dall'Argine et al. ..... 241/85

* cited by examiner

*Primary Examiner*—Mark Rosenbaum
(74) *Attorney, Agent, or Firm*—Birch, Stewart, Kolasch & Birch, LLP

(57) ABSTRACT

An apparatus for wiredrawing vegetables or cutting them into three dimensional shapes, comprising a base frame, a first container supported by said base frame for collecting residues, a drum mounted for rotation about an axis on the surface of die cells, a vegetable feeding means supported on said base frame and arranged above said drum to adjustably feed vegetables into said cutting means, pressing means located downstream of said feeding means with respect to the direction of rotation of said drum, and designed to wiredrawing said vegetables into said die cells, clearing means arranged downstream of said pressing means and designed to force out into said pressing drum any wiredrawn vegetables held in said die cells, and a second container supported by said frame underneath said drum and arranged to receive wiredrawn vegetables present in said drum.

10 Claims, 2 Drawing Sheets

APPARATUS FOR WIREDRAWING VEGETABLES OR DICING THEM INTO THREE DIMENSIONAL SHAPES

TECHNICAL FIELD

The present invention relates to an apparatus for dicing vegetables or chopping them up into different three dimensional shapes.

BACKGROUND OF THE INVENTION

Automatic machines for dicing or chopping up vegetables into different three dimensional shapes have been known for a long time, and are provided with devices consisting of punched drums within which respective pressing rollers are mounted, said rollers being normally rubber coated and eccentrically motioned, and squeezing the vegetables placed inside said drums, in such a way as to get them to wiredraw towards the outside, through dies provided on the drums, the dies being provided with suitable pre-stamped contours, according to the three dimensional shape to be obtained.

Outside the drums scrapers are provided that collect the chopped vegetable sticks; rind, juice and pips are likely to end up being trapped inside the cylinder from which they are eventually removed.

A further machine is also known wherein sets of knives are used, the knives arranged in different directions and being crossed; each set of knives consisting of an array of knives placed next to one another at a constant predetermined pitch.

The vegetables are moved to said sets of knives that cut them into sticks first, and then into three dimensionally shaped chips.

A third automatic machine known in the art for that purpose consists of a belt of punched templates that make up a sort of conveyor belt running on driving and transmission gearwheels.

Above said belt, at least one pressing roller and, downstream of it, a rotating brush, are provided.

A dispenser places the vegetables onto the upper run of said conveyor belt that advances constantly, and the pressing roller pushes the vegetables to wiredraw through the templates and to fall into a collection basin positioned underneath; at that stage the vegetables are already shaped as three dimensional chips whose contour matches that of the dies the templates are provided with.

The brush downstream of said pressing roller clears the templates from the debris that may have got stuck in it.

However, these machines known in the art have some drawbacks that make them employable just on selected types of vegetables.

In fact, the first two types of machines heretofore described can only be used for vegetables whose pulp is firm, such as potatoes, cucumbers, and the like, whereas they cannot be properly employed for cutting tomatoes, as these would be irreparably squashed and mushed.

A third machine known in the art, and this is conversely mainly employed with satisfactory results with tomatoes.

Nonetheless its lengthwise encumbrance accordingly requires that a remarkable space be taken for its positioning.

Moreover, it was observed that the rotation of the brush does not exert enough of a cleaning action onto the templates to clear them of all residual debris after wiredrawing; given the repetitiveness of the production cycle, this can give way to a growing clogging affecting most of the openings the templates are provided with. In order to reestablish proper operation, such a thing raises the need to shutdown the machine, disassemble the templates and clean them thoroughly, fix them back onto the machine, all these operations involving an inconveniently remarkable waste of time and soaring of maintenance costs.

SUMMARY OF THE INVENTION

It is an object of the present invention to overcome the above mentioned drawbacks by providing an apparatus for dicing vegetables or chopping them up into various three dimensional shapes, that minimizes all structural encumbrances, that is provided with an effective cleaning device operating without requiring discontinuation of production cycles, and that can be universally employed for any type of vegetables.

This and other objects are attained by an apparatus for wiredrawing vegetables or cutting them into three dimensional shapes, comprising a base frame, a first container supported by said base frame for collecting residues, a drum mounted for rotation about an axis on the said base frame, cutting means arranged on the outer surface of die cells, a vegetable feeding means supported on said base frame and arranged above said drum to adjustably feed vegetables into said cutting means, pressing means located downstream of said feeding means with respect to the direction of rotation of said drum, and designed to wiredrawing said vegetables into said die cells, clearing means arranged downstream of said pressing means and designed to force out into said pressing drum any wiredrawn vegetables held in said die cells, and a second container supported by said frame underneath said drum and arranged to receive wiredrawn vegetables present in said drum.

BRIEF DESCRIPTION OF THE DRAWINGS

Further features and advantages of the present invention will better appear from the following detailed description of one preferred embodiment thereof given merely by way of non-limiting example, with reference to the accompanying drawings, wherein.

DESCRIPTION OF THE PREFERRED EMBODIMENTS

Figure 1:
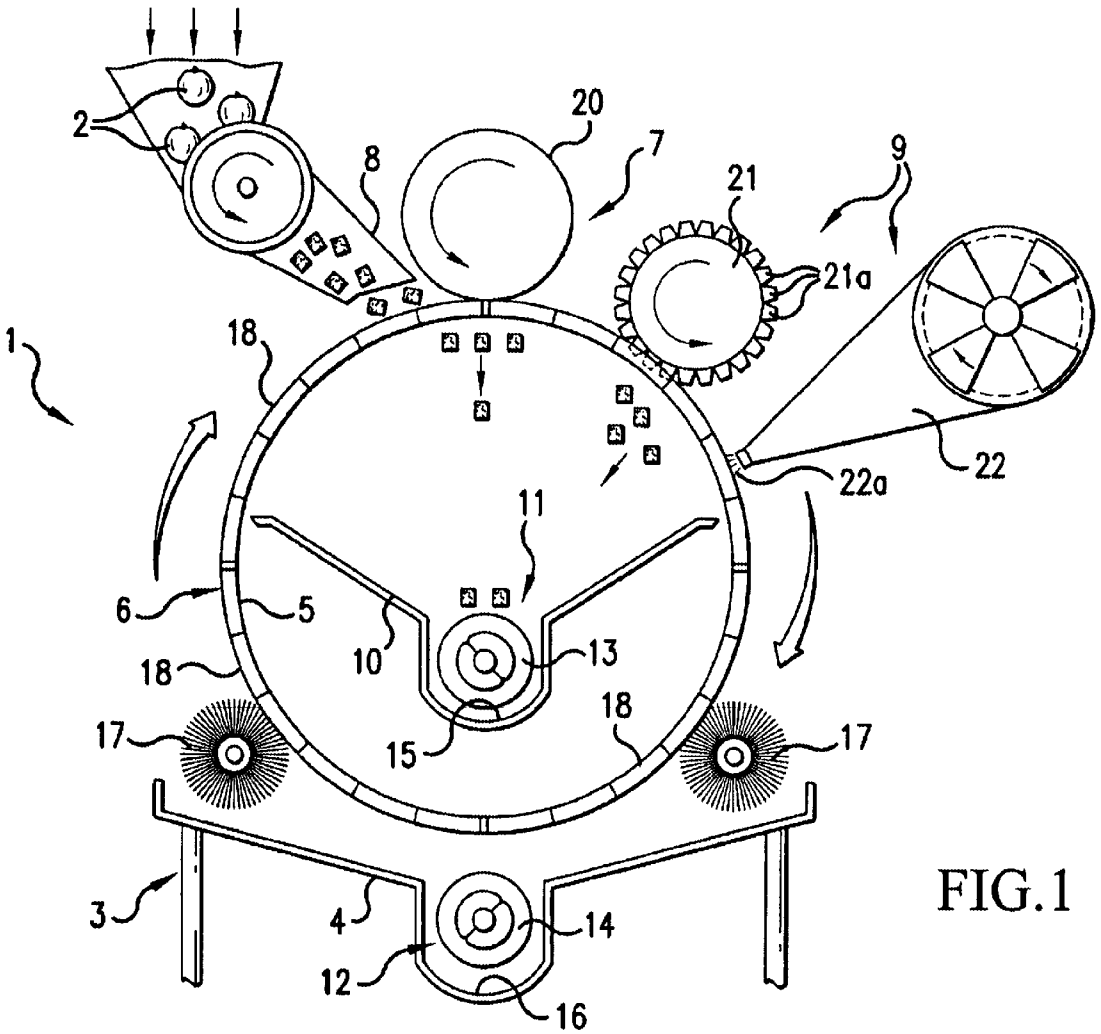
FIG. 1 shows a diagrammatic side view of the dicing apparatus according to the present invention.
Figure 2:
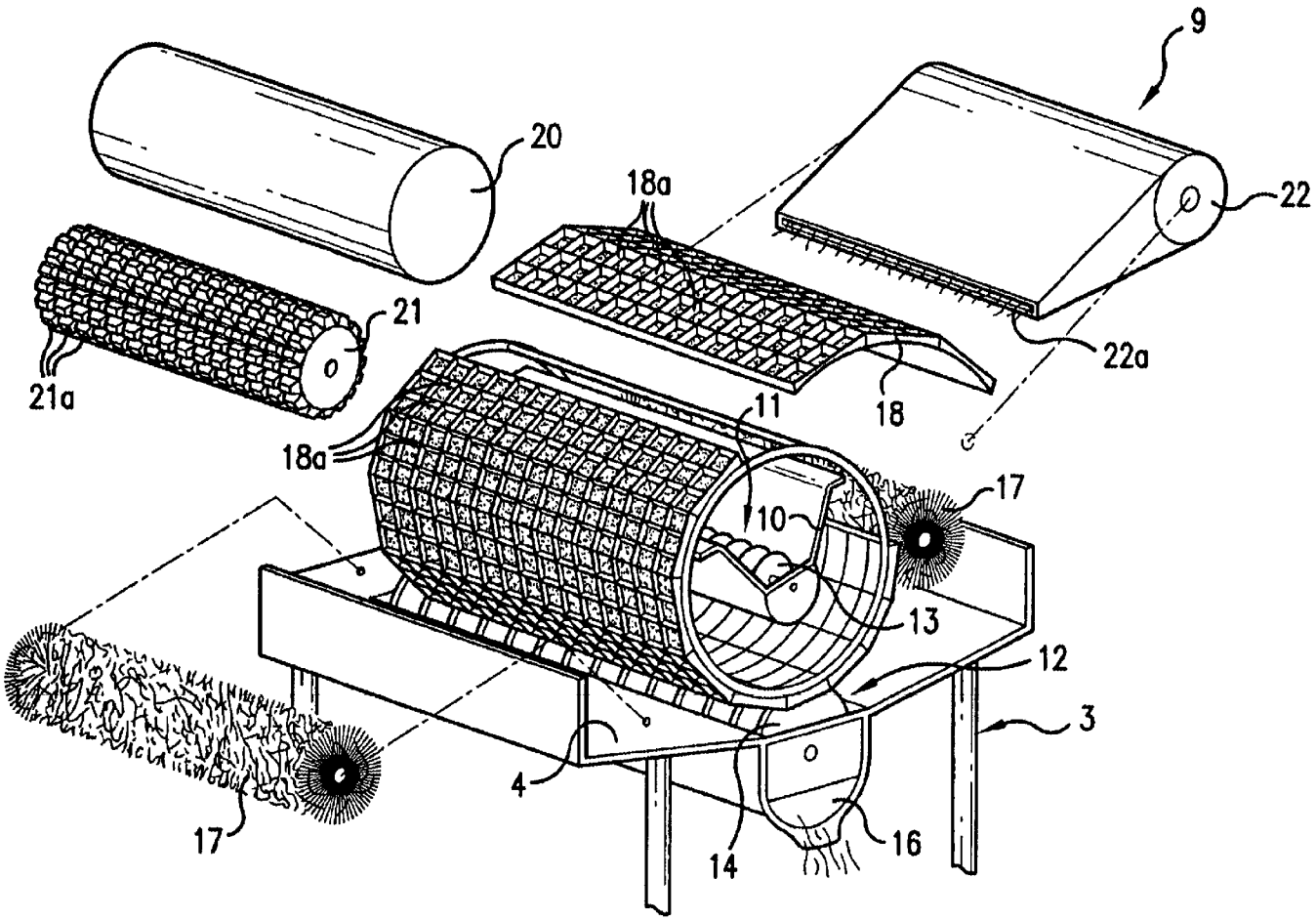
FIG. 2 shows a partially exploded perspective view of the dicing apparatus of FIG. 1.

With reference to the drawings, the apparatus according to the invention for chopping up vegetables (2) which have previously been diced or cut into long sticks or other three dimensional shapes, has been generally indicated with reference numeral (1).

Apparatus (1) essentially consists of a base frame (3) supporting a first container (4) for collecting debris from vegetable (2) cutting or dicing operation.

Above first container (4) a drum (5) is mounted, said drum being driven to rotate as known in the art about a horizontal axis, and being peripherally provided with means (6) for cutting by wiredrawing vegetable sticks (2), onto whose substantially upper surface a pressing member (7) exerts its pressure.

Upstream of said pressing member (7), an inlet (8) is provided, from which vegetable sticks (2) are fed whereas downstream removing means (9) are provided for clearing the wiredrawing cutting means (6) for wiredrawing from the debris present on it.

Within drum (5) a second basin (10) is provided for collection of vegetables (2) after these have been diced or chopped up into different predetermined three dimensional shapes.

Both first container (4), and collection container (10) are provided with means (11) and (12) for sampling and removing the chips produced, means (11) and (12) both consisting of respective motor driven metering screws (13) and (14), which are arranged essentially coaxially with said drum in respective concave seats (15) and (16) centrally provided and formed in containers (4) and (10).

On both sides of drum (5), preferably at the lower portion thereof, contained within the profile of first container (4), at least one pair of cylindrically shaped brushes (17) is provided, said brushes rotating about axes that are parallel with that of drum 5 and penetrating between said wiredrawing cutting means (6).

According to a first embodiment, said cutting means (6) for wiredrawing consists of a set of templates (18) with both upper and lower openings, and that are mounted in such a way as to be transversally adjacent to each other, between the ends of drum (5), making up the outer surface thereof. Templates (18) that total up to four in this specific embodiment, each one of them making up a quarter of drum (5), are provided on their inner surface of blades (18*a*) that after positioning in a cutting fashion, cross and define the cross section of the three dimensional shapes of chipped vegetables (2).

The pressing member (7) consists of at least a first cylinder (20) (see FIG. 1) which is positioned so as to tangentially abut against the upper faces of templates (18) mounted on drum (5).

The outer surface of said first cylinder (20) is advantageously resiliently yielding.

Means (9) for removing and cleaning consists of at least a roller (21) whose outer surface is provided with dowels, and mounted so as to rotate about an axis that is parallel with the axes of first roller (20) and drum (5).

Dowels (21*a*) of roller (21) make up the outer surface thereof and are so shaped that they allow the introduction thereof into the hollows defined by blades (18*a*) of templates (18).

The removing and cleaning means (9) for debris removal can optionally comprise at least one blowing unit (22) that is positioned downstream of roller (21) provided with templates and that has feeding inlet (22*a*) that extends along the whole length of drum (5) along it axis, and positioned so as to graze the upper faces of template (18).

According to a (not shown) second embodiment of the present invention (not shown in the drawings), said cutting means (6) for wiredrawing, can optionally consist of a continuous grating having a pre-shaped mesh, which is directly mounted between the ends of drum (5) and that, together with said ends, makes up the structure thereof. The grating has a mesh also comprising a plurality of crossed blades (18*a*) and forming the contours of the three dimensional shapes of the vegetable chips aimed at being produced.

The operation of the present invention can be easily understood from the following: Vegetables (2), specifically tomatoes, are fed to templates (18) through feeding inlet (8), as precut sticks. By its rotation, the drum translates said sticks underneath cylinder (20) that presses them forcing them to be wiredrawn through the openings delimited by blades (18*a*) of the templates (18).

Henceforth, on leaving said templates (18), the tomato chips have a three-dimensional shape defined by the contours of the dies which can be shaped as desired, by suitably positioning blades (18*a*) in a crossed fashion, it being therefore possible to obtain sticks having hexagon, square, star, miscellaneous cross-section.

On leaving templates (18), the chips fall into collection container (10) and they are removed from said container by dint of the action of metering screw (13) suitably positioned within a respective concave seat (15).

The chips normally fall by gravity; however in case some of them are stuck between blades (18*a*), the translation of templates (18) to a position underneath roller (21) provided with dowels allows dowels (21*a*) to penetrate into the dies thereof, forcing any possible residual chip out of them.

As drum (5) keeps rotating, all templates (18) are subjected to the action exerted by the blowing unit and directed to the cleaning from debris (rind, pips, an so on); the debris is collected by first container (4) and removed from metering screw (14), which is itself positioned inside its concave seat (16).

The pair of brushes (17) accomplishes the cleaning of templates (18) that repeat the above detailed chopping up cycle that matches each and every rotation of the drum (5).

It was basically ascertained that the machine according to the present invention accomplishes its objects as set out above.

The apparatus according to the present invention is susceptible to several modifications and variations without nonetheless departing from the scope of the instant present.

Moreover all details can be replaced by technically equivalent details.

The disclosure in Italian patent application No. MO2001A000025 filed on Feb. 15, 2001 from which priority is claimed is incorporated herein by reference.

What is claimed is:

1. An apparatus for wiredrawing vegetables or cutting them into three dimensional shapes, comprising a base frame, a first container supported by said base frame for collecting residues, a drum mounted for rotation about an axis on the said base frame, cutting means arranged on an outer surface of die cells, a vegetable feeding means supported on said base frame and arranged above said drum to adjustably feed vegetables into said cutting means, a pressing drum located downstream of said feeding means with respect to the direction of rotation of said drum, and designed to wiredrawing said vegetables into said die cells, clearing means arranged downstream of said pressing means and designed to force out into said pressing drum any wiredrawn vegetables held in said die cells, and a second container supported by said frame underneath said drum and arranged to receive wiredrawn vegetables present in said drum.

2. An apparatus as claimed in claim 1, further comprising at least one cleaning rotating brush supported by said frame in operating contact with said cutting means thereby affecting said die cells.

3. An apparatus as claimed in claim 2, wherein said a sampling and removal means comprises respective motor-driven metering screws, located coaxial with the drum and seated in respective concave shaped seats formed in said container.

4. An apparatus as claimed in claim 1, wherein said wiredrawing cutting means comprises a sequence of templates formed with substantially tubular die cells arranged to constitute said outer surface of said drum, each template being provided with blades having their cutting edge facing outwardly.

5. An apparatus as claimed in claim 4, wherein said templates total up to four in number, each one of them extending throughout one quarter of said outer surface of said drum.

6. An apparatus as claimed in claim 1, wherein said pressing means comprises at least one cylinder arranged to rotate against said outer surface of said drum.

7. An apparatus as claimed in claim 6, wherein said at least one cylinder has a resiliently yielding outer surface.

8. An apparatus as claimed in claim 1, wherein a removal means comprises at least one rotatable roller, having the outer surface thereof provided with dowels for engaging into said die cells.

9. An apparatus as claimed in claim 8, wherein said removal means comprises at least one blowing unit positioned downstream of said rotatable roller, arranged to direct at least one air jet onto said die cells throughout the width of said drum.

10. An apparatus as claimed in claim 1, wherein said first container and said second collection container are provided with means for sampling and removing said wiredrawn vegetables.

* * * * *